US008479929B1

(12) United States Patent
Kao

(10) Patent No.: US 8,479,929 B1
(45) Date of Patent: Jul. 9, 2013

(54) SCREWDRIVER HANGING ASSEMBLY

(76) Inventor: Jui-Chien Kao, Taichung (TW)

( * ) Notice: Subject to any disclaimer, the term of this patent is extended or adjusted under 35 U.S.C. 154(b) by 86 days.

(21) Appl. No.: 13/329,098

(22) Filed: Dec. 16, 2011

(51) Int. Cl.
*B25H 3/04* (2006.01)

(52) U.S. Cl.
USPC ..... 211/70.6; 211/69; 211/94.01

(58) Field of Classification Search
USPC ..... 211/70.6, 94.01, 69, 60.1, 183; 206/376, 206/372, 483, 480, 477
See application file for complete search history.

(56) References Cited

U.S. PATENT DOCUMENTS

| | | | | |
|---|---|---|---|---|
| 5,645,177 | A * | 7/1997 | Lin | 211/70.6 |
| 6,105,794 | A * | 8/2000 | Bauer | 211/94.01 |
| 6,367,628 | B2 * | 4/2002 | Hu | 206/377 |
| 6,386,363 | B1 * | 5/2002 | Huang | 206/378 |
| 6,431,373 | B1 * | 8/2002 | Blick | 211/70.6 |
| 6,626,402 | B1 * | 9/2003 | Kaminstein | 248/110 |
| 7,080,733 | B2 * | 7/2006 | Kao | 206/372 |
| 7,434,700 | B2 * | 10/2008 | Kao | 211/70.6 |
| 7,694,832 | B2 * | 4/2010 | Kao | 211/70.6 |
| 7,717,278 | B2 * | 5/2010 | Kao | 211/70.6 |
| 7,950,534 | B2 * | 5/2011 | Kao | 211/70.6 |
| 7,980,400 | B2 * | 7/2011 | Kao | 211/70.6 |
| 8,069,995 | B2 * | 12/2011 | Winnard | 211/70.6 |
| 8,152,003 | B1 * | 4/2012 | Kao | 211/70.6 |
| 8,286,807 | B2 * | 10/2012 | Winnard | 211/70.6 |
| 8,302,785 | B2 * | 11/2012 | Kao | 211/70.6 |
| 8,302,786 | B2 * | 11/2012 | Kao | 211/70.6 |
| 8,403,155 | B1 * | 3/2013 | Kao | 211/70.6 |
| 2001/0010291 | A1 * | 8/2001 | Hu | 206/377 |
| 2005/0173279 | A1 * | 8/2005 | Chen | 206/372 |
| 2005/0230335 | A1 * | 10/2005 | Chiu et al. | 211/70.6 |
| 2007/0017886 | A1 * | 1/2007 | Kao | 211/94.01 |
| 2009/0218302 | A1 * | 9/2009 | Winnard | 211/70.6 |
| 2010/0133213 | A1 * | 6/2010 | Kao | 211/70.6 |
| 2010/0163502 | A1 * | 7/2010 | Chang | 211/70.6 |
| 2011/0011813 | A1 * | 1/2011 | Kao | 211/70.6 |
| 2011/0132853 | A1 * | 6/2011 | Drobot et al. | 211/42 |
| 2012/0111814 | A1 * | 5/2012 | Kao | 211/70.6 |
| 2012/0138553 | A1 * | 6/2012 | Kao | 211/70.6 |
| 2012/0152871 | A1 * | 6/2012 | Kao | 211/70.6 |

* cited by examiner

*Primary Examiner* — Jennifer E Novosad
(74) *Attorney, Agent, or Firm* — patenttm.us

(57) ABSTRACT

A screwdriver hanging assembly has a main frame and two connecting devices. The main frame has two track grooves formed in the main frame and parallel to each other. The connecting devices are respectively connected with the track grooves. Each connecting device has multiple brackets for holding multiple screwdrivers. Because combining the connecting devices having the multiple brackets with the main frame is easy, to assemble the connecting devices with the main frame is quick, reduces manufacturing cost and is convenient for holding multiple screwdrivers.

5 Claims, 15 Drawing Sheets

SCREWDRIVER HANGING ASSEMBLY

BACKGROUND OF THE INVENTION

1. Field of the Invention

The present invention relates to a screwdriver hanging assembly, and more particularly to a screwdriver hanging assembly to save time for assembling.

2. Description of Related Art

A conventional tool hanger assembly has a main frame and multiple connecting devices. The main frame has two track grooves formed in the main frame and parallel to each other. The connecting devices are slidably mounted on the track grooves. Each connecting device has a bracket protruding from the connecting device and being capable of holding a screwdriver.

However, the connecting devices have to be attached to the main frame one by one, so to assemble the multiple connecting devices onto the main frame is time-consuming, increases manufacturing cost and is not convenient.

To overcome the shortcomings, the present invention tends to provide a screwdriver hanging assembly to mitigate the aforementioned problems.

SUMMARY OF THE INVENTION

The main objective of the invention is to provide a screwdriver hanging assembly to save time for assembling.

A screwdriver hanging assembly has a main frame and two connecting devices. The main frame has two track grooves formed in the main frame and parallel to each other. The connecting devices are respectively connected with the track grooves. Each connecting device has multiple brackets for holding multiple screwdrivers. Because combining the connecting devices having the multiple brackets with the main frame is easy, to assemble the connecting devices with the main frame is quick, reduces manufacturing cost and is convenient for holding multiple screwdrivers.

Other objects, advantages and novel features of the invention will become more apparent from the following detailed description when taken in conjunction with the accompanying drawings.

BRIEF DESCRIPTION OF THE DRAWINGS

FIG. 11 showing multiple screwdrivers held by the screwdriver hanging assembly;

DETAILED DESCRIPTION OF PREFERRED EMBODIMENT

Figure 1:
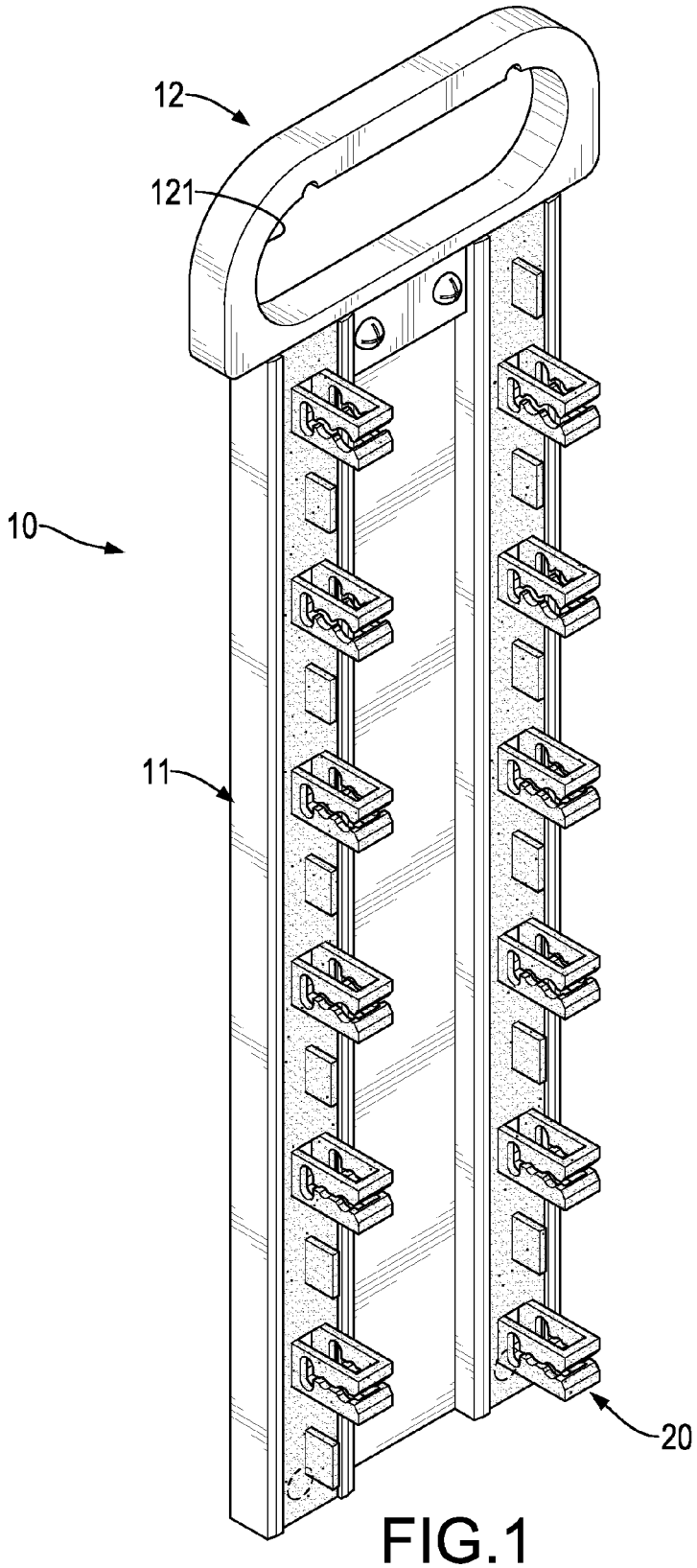
FIG. 1 is a perspective view of a first embodiment of a screwdriver hanging assembly in accordance with the present invention.
Figure 2:
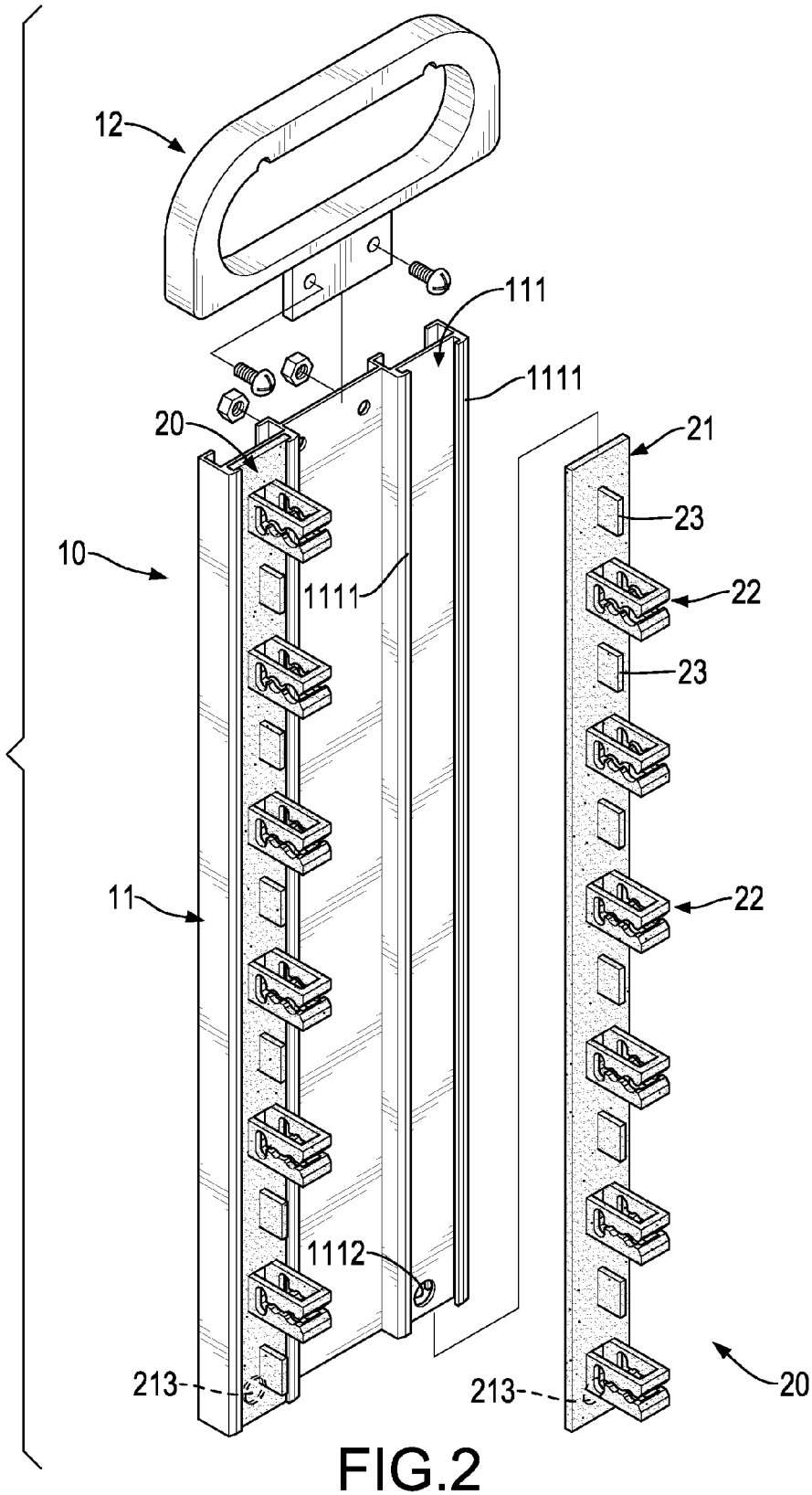
FIG. 2 is a partially exploded perspective view of the screwdriver hanging assembly in FIG. 1.

With reference to FIGS. 1 and 2, a first embodiment of a screwdriver hanging assembly in accordance with the present invention comprises a main frame 10 and two connecting devices 20.

Figure 5:
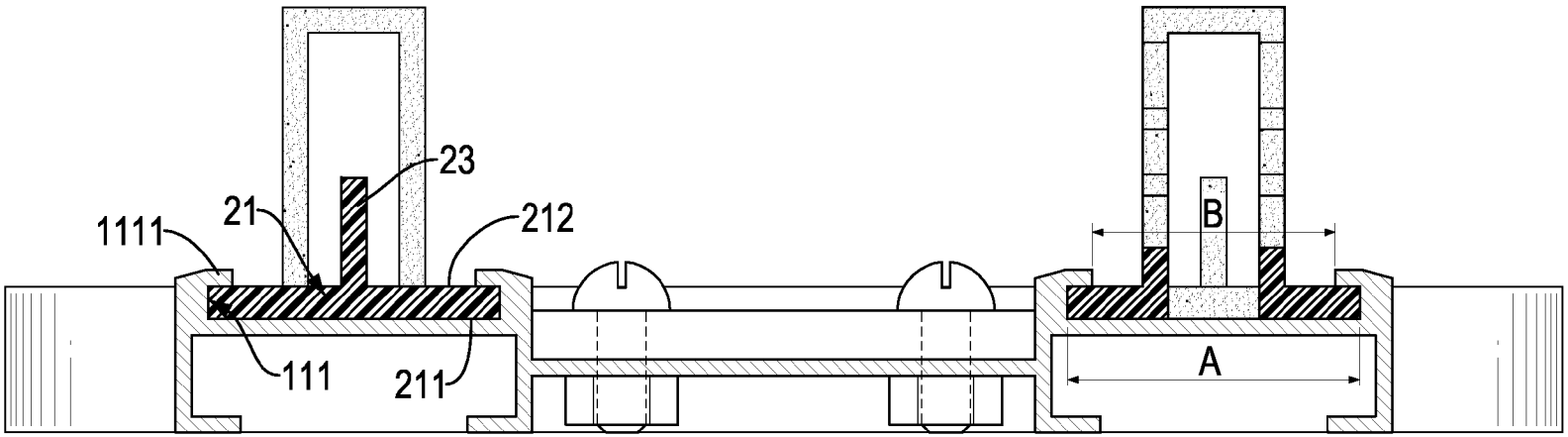
FIG. 5 is an enlarged cross sectional side view of the screwdriver hanging assembly along line 5-5 in FIG. 3.

With reference to FIGS. 1, 2 and 5, the main frame 10 has a main plate 11 and a hanging plate 12. The main plate 11 has a rectangular cross section and has two track grooves 111. The track grooves 111 are longitudinally elongated and are parallel to each other. Each track groove 111 has two edges, a bottom, two opposite inner surfaces, two strips 1111 and a positioning hole 1112. The edges of each track groove 111 are longitudinally elongated. A distance between the inner surfaces of each track groove 111 is defined as a first width A.

The two elongated strips 1111 of each track groove 111 are longitudinally elongated, are parallel to each other and are respectively and integrally connected with the edges of the track groove 111. A distance between the strips 1111 of each track groove 111 is defined as a second width B. The second width B is shorter than the first width A.

The positioning hole 1112 of each track groove 111 is formed through the bottom of the track groove 111 and is adjacent to a bottom of the main plate 11.

The hanging plate 12 is mounted securely on a top of the main plate 11 by fasteners and has a hanging hole 121 formed through the hanging plate 12. With the hanging hole 121, the screwdriver hanging assembly can be hung or carried.

Figure 3:
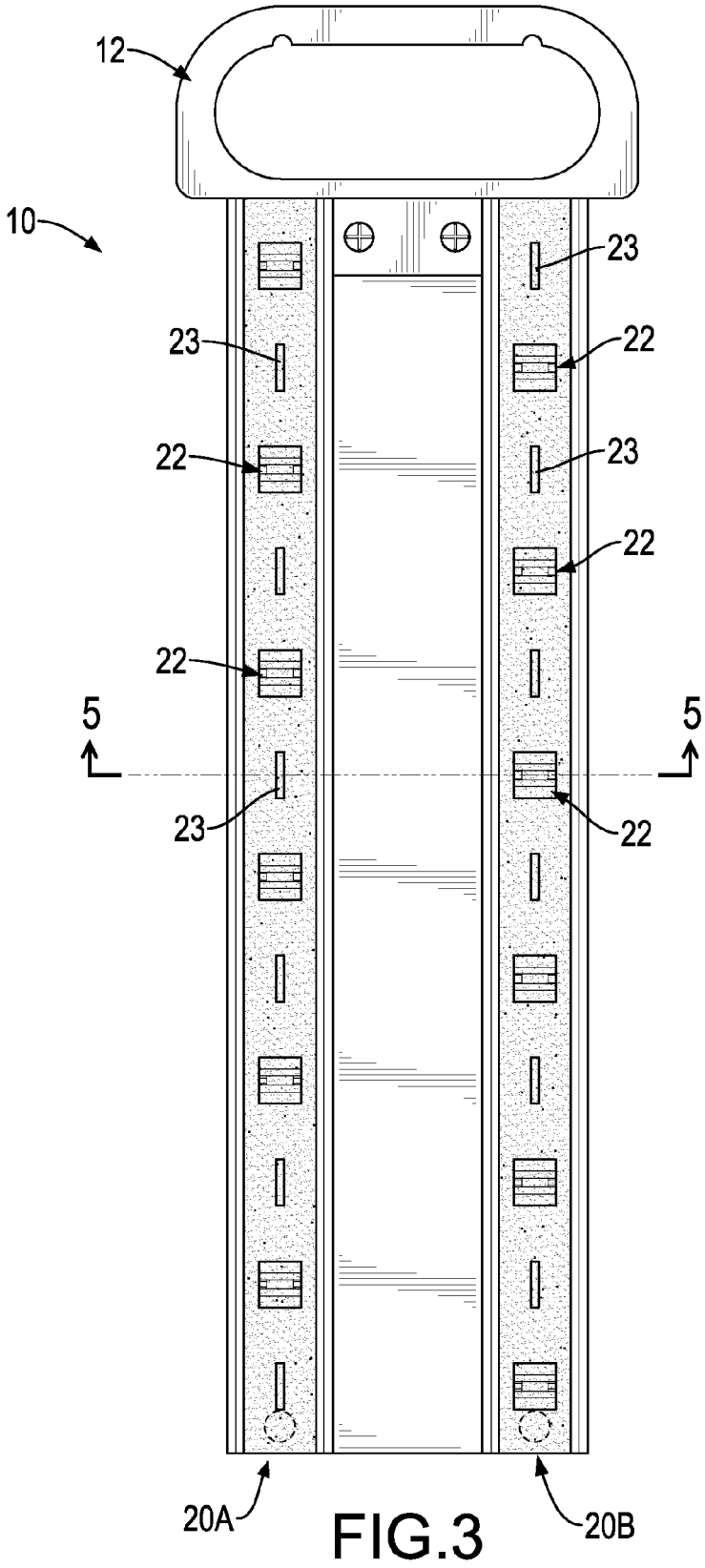
FIG. 3 is a front view of the screwdriver hanging assembly in FIG. 1.
Figure 4:
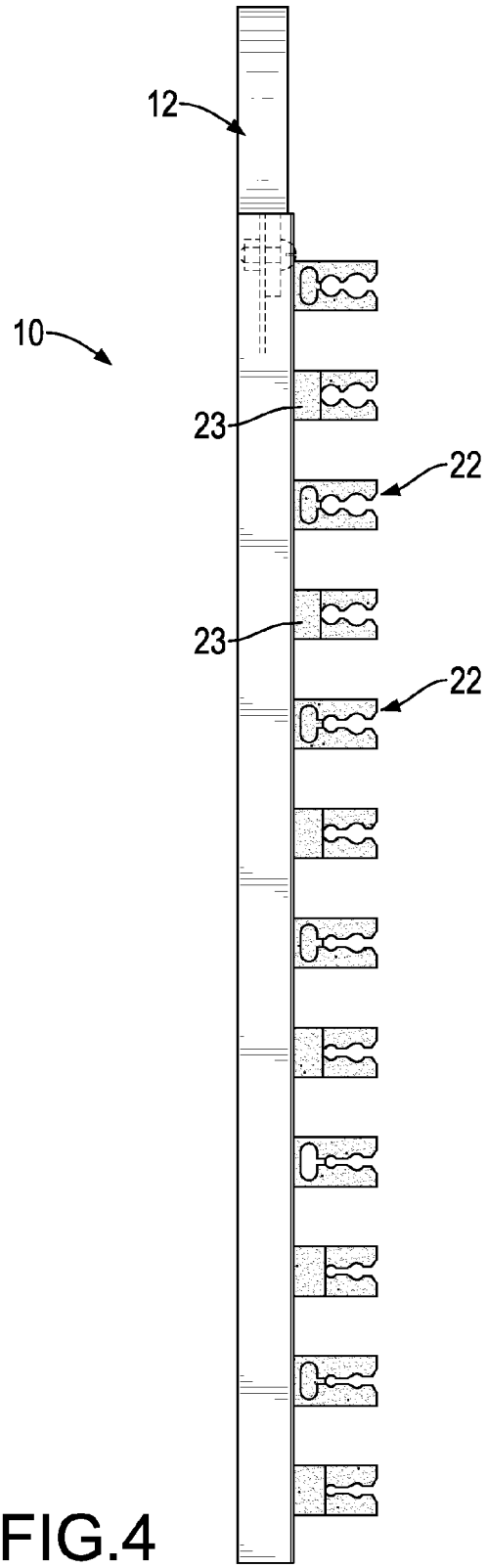
FIG. 4 is a left side view of the screwdriver hanging assembly in FIG. 1.

With reference to FIGS. 3 to 5, the connecting devices 20 are respectively connected with the track grooves 111 and are respectively defined as a first connecting device 20A and a second connecting device 20B. Each connecting device 20 is elongated and has a base plate 21, multiple brackets 22 and multiple chunks 23.

The base plate 21 of each connecting device 20 is securely mounted in a corresponding one of the track grooves 111 and has a length, an abutted surface 211, a connecting surface 212 and a button 213. The length of each base plate 21 is the same as that of the track groove 111. The abutted surface 211 of each base plate 21 abuts the bottom of the track groove 111. The connecting surface 212 of each base plate 21 is opposite to the abutted surface 211 of the base plate 21 and is abutted by the two strips 1111 of the track groove 111. Because the second width B is shorter than the first width A, the strips 1111 prevent the base plates 21 from escaping from the main frame 10. The button 213 of each base plate 21 is securely mounted on and protrudes from the abutted surface 211 and is mounted in and engages the positioning hole 1112 of the track groove 111.

Figure 8:
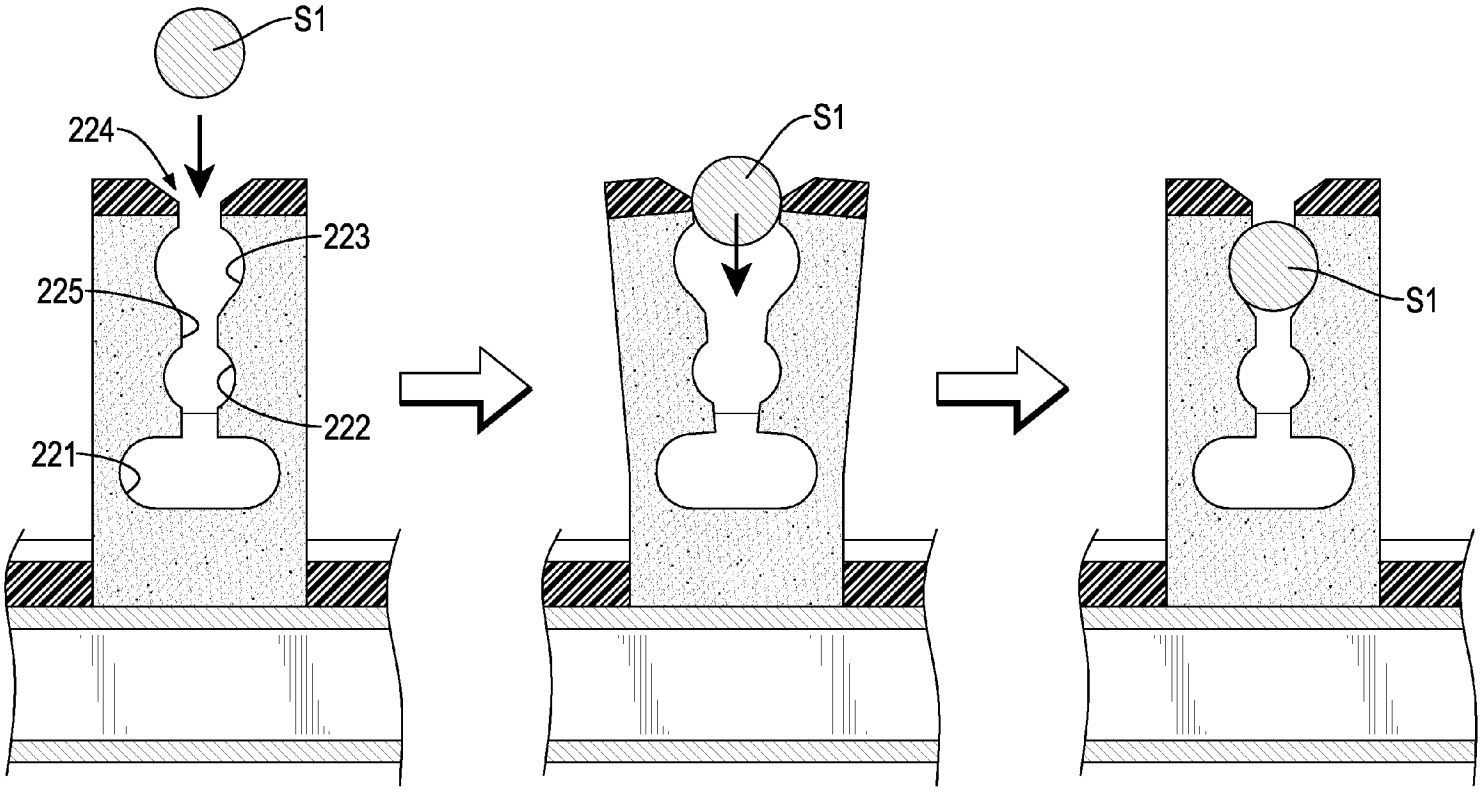
FIG. 8 is enlarged operational cross sectional side views of the screwdriver hanging assembly in FIG. 1 showing a shank of a screwdriver being put into a second shank hole.
Figure 9:
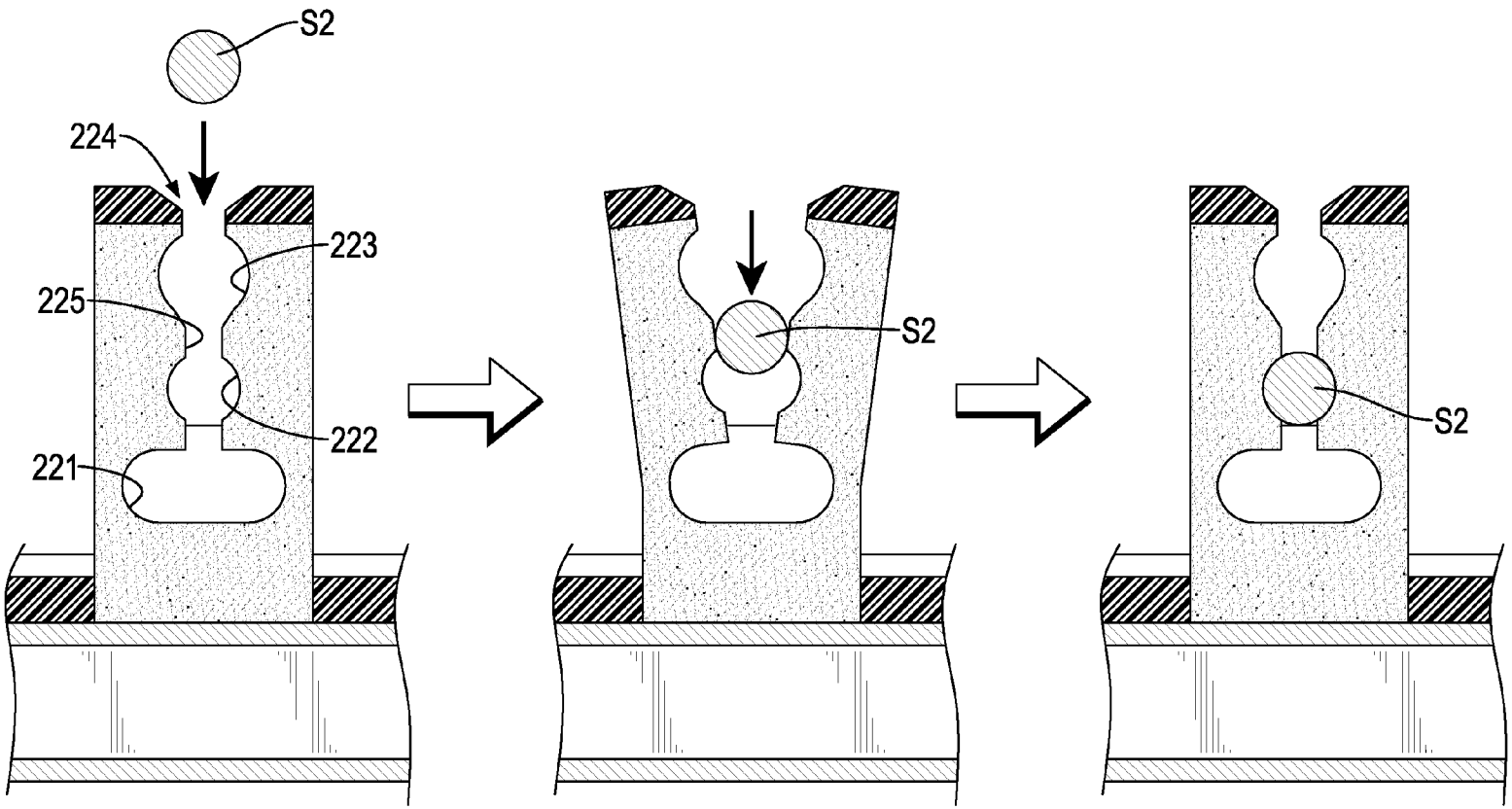
FIG. 9 is enlarged operational cross sectional side views of the screwdriver hanging assembly in FIG. 1 showing a shank of a screwdriver being put into a first shank hole.

With further reference to FIGS. 8 and 9, the brackets 22 of each connecting device 20 are securely mounted on the connecting surface 212 of the connecting device 20 at intervals. Each bracket 22 has an enlarged hole 221, a first shank hole 222, a second shank hole 223 and a bracket opening 224 in sequence.

The enlarged hole 221 of each bracket 22 is formed through the bracket 22 and is adjacent to the connecting surface 212.

The first shank hole 222 of each bracket 22 is formed through the bracket 22, communicates with the enlarged hole 221 and has a diameter.

The second shank hole 223 of each bracket 22 is formed through the bracket 22, communicates with the first shank hole 222 and has a diameter different from that of the first shank hole 222. Preferably, the diameter of each first shank hole 222 is smaller than that of each second shank hole 223.

The bracket opening 224 of each bracket 22 is formed in an end surface of the bracket 22 opposite to the corresponding connecting surface 212, is formed through the bracket 22 and communicates with the second shank hole 223. The enlarged hole 221, the first shank hole 222, the second shank hole 223 and the bracket opening 224 of each bracket 22 are arranged in a straight line.

Preferably, each bracket 22 further has an extending hole 225 formed through the bracket 22, located between and communicating with the first shank hole 222 and the second shank hole 223 and having a width shorter than the diameters of the first shank hole 222 and the second shank hole 223.

The chunks 23 of each connecting device 20 are securely mounted on the connecting surface 212 of the connecting device 20 at intervals and respectively between the brackets 22. Each chunk 23 has a rectangular cross section. The chunks 23 of the first connecting device 20A respectively align with the brackets 22 of the second connecting device 20B and the brackets 22 of the first connecting device 20A respectively align with the chunks 23 of the second connecting device 20B.

In assembling, the base plates 21 are respectively slid into the track grooves 111. After the buttons 213 are mounted in and engage the positioning holes 1112, the connecting devices 20 are securely positioned and kept from falling off the main frame 10. Accordingly, combining the connecting devices 20 having the multiple brackets 22 with the main frame 10 is easy and quick, and the manufacturing cost is reduced.

With reference to FIG. 8, a shank S1 of a screwdriver S having a cross section is inserted from the bracket opening 224 to squeeze the bracket 22 and then is positioned in the second shank hole 223. Similarly, with reference to FIG. 9, a shank S2 of a screwdriver S having a different cross section is inserted from the bracket opening 224, through the second shank hole 223 and the extending hole 225 and then is positioned in the first shank hole 222. Accordingly, shanks S1,S2 of different sizes can be selectively put into the first shank holes 222 and the second shank holes 223 and a suitable positioning effect is provided. Moreover, the enlarged holes 221 allow the bracket openings 224, the second shank holes 223, the extending holes 225 and the first shank holes 222 to be expanded and to allow the shanks S1,S2 to enter the corresponding holes 222,223.

Figure 6:
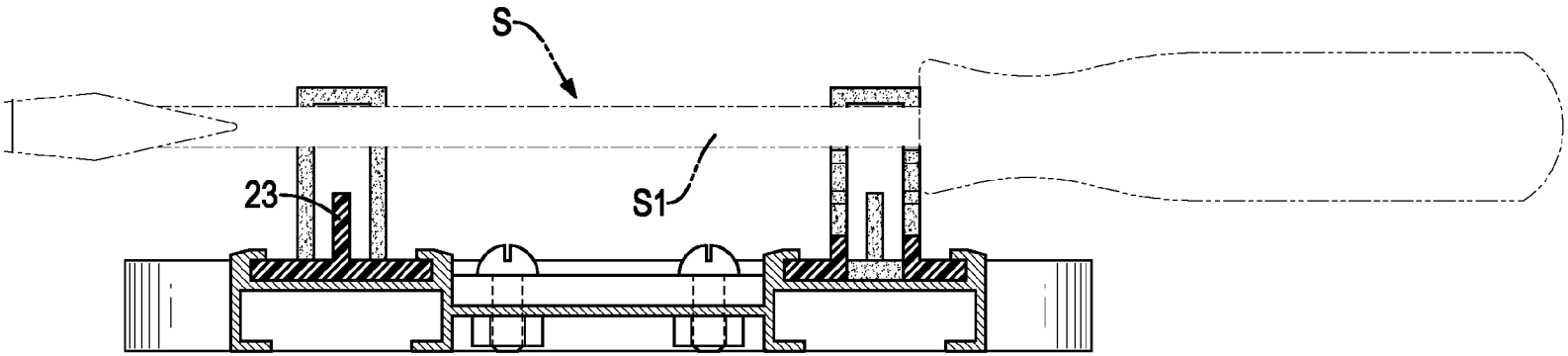
FIG. 6 is an operational side view of the screwdriver hanging assembly in FIG. 5 holding a screwdriver.
Figure 7:
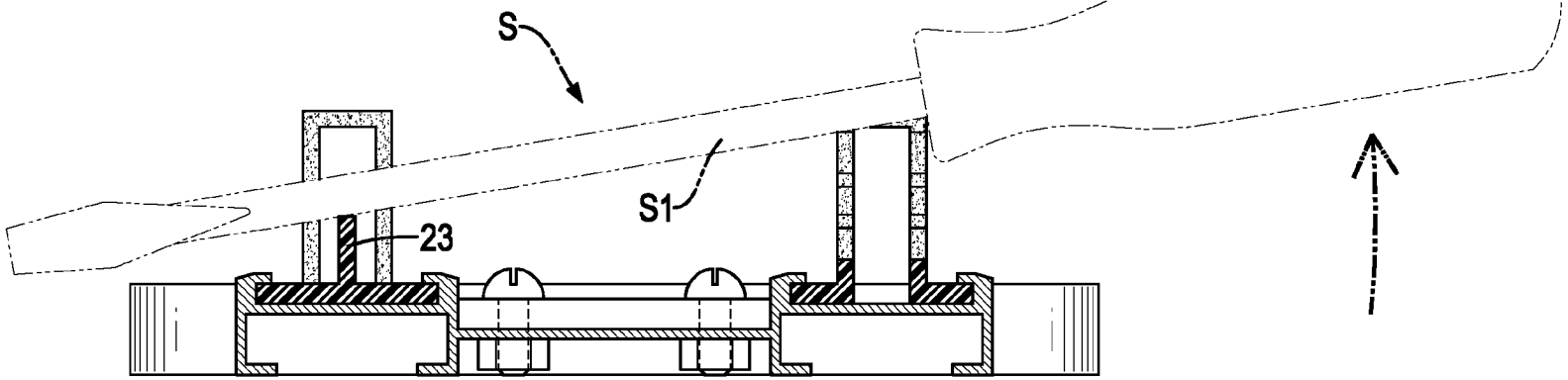
FIG. 7 is an operational side view of the screwdriver hanging assembly in FIG. 6 showing the screwdriver being detached from the screwdriver hanging assembly.

With reference to FIGS. 6 and 7, a handle of a screwdriver S is lifted upwardly to make a shank S1 of the screwdriver S abut the chunk 23. Therefore, a position where the shank S1 abuts the chunk 23 serves as a fulcrum to facilitate taking the shank S1 out of the corresponding holes 222,223.

Figure 10:
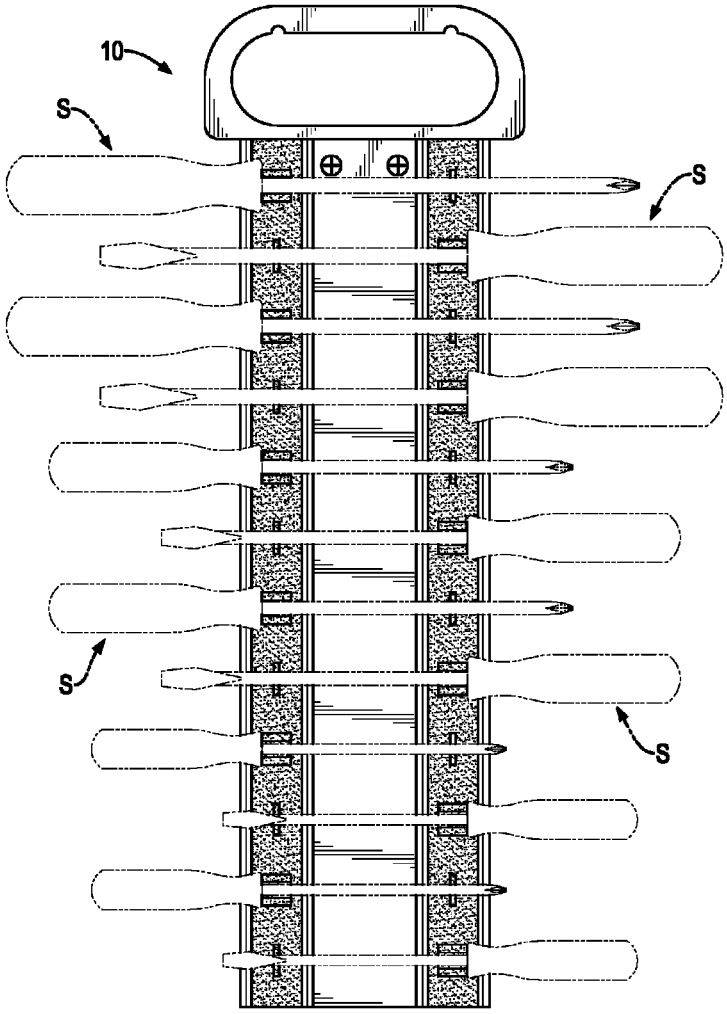
FIG. 10 is an operational front view of the screwdriver hanging assembly in FIG. 1, showing multiple screwdrivers held by the screwdriver hanging assembly.
Figure 11:
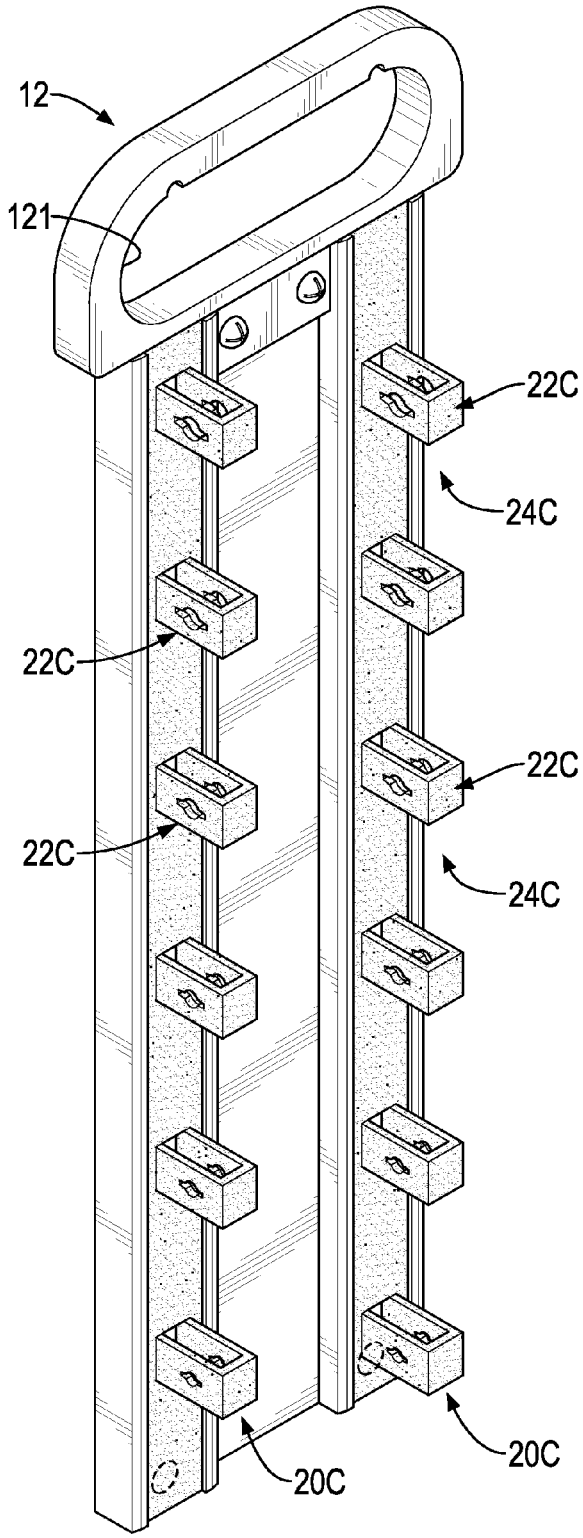
FIG. 11 is a perspective view of a second embodiment of the screwdriver hanging assembly in accordance with the present invention.
Figure 12:
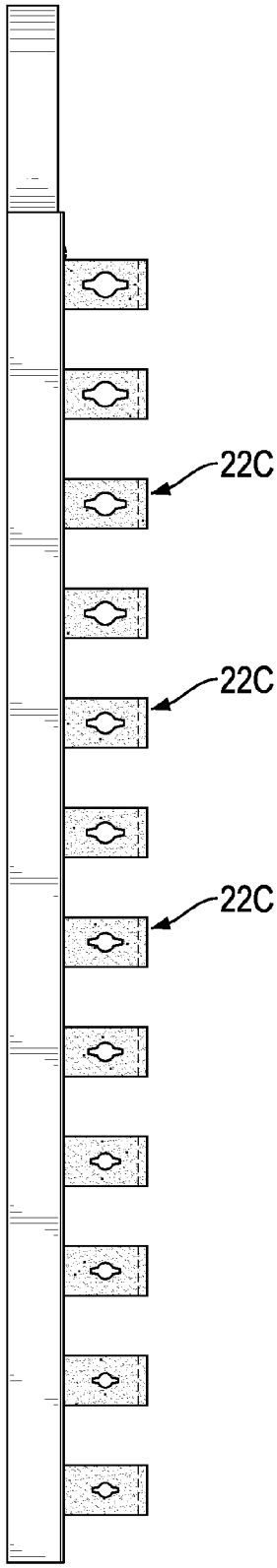
FIG. 12 is a left side view of the screwdriver hanging assembly in FIG. 11.
Figure 13:
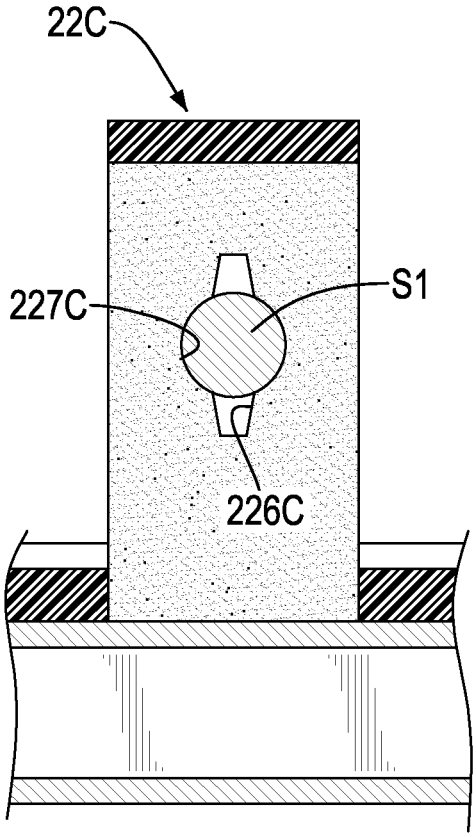
FIG. 13 is an enlarged cross sectional side view of the screwdriver hanging assembly in FIG. 11.
Figure 14:
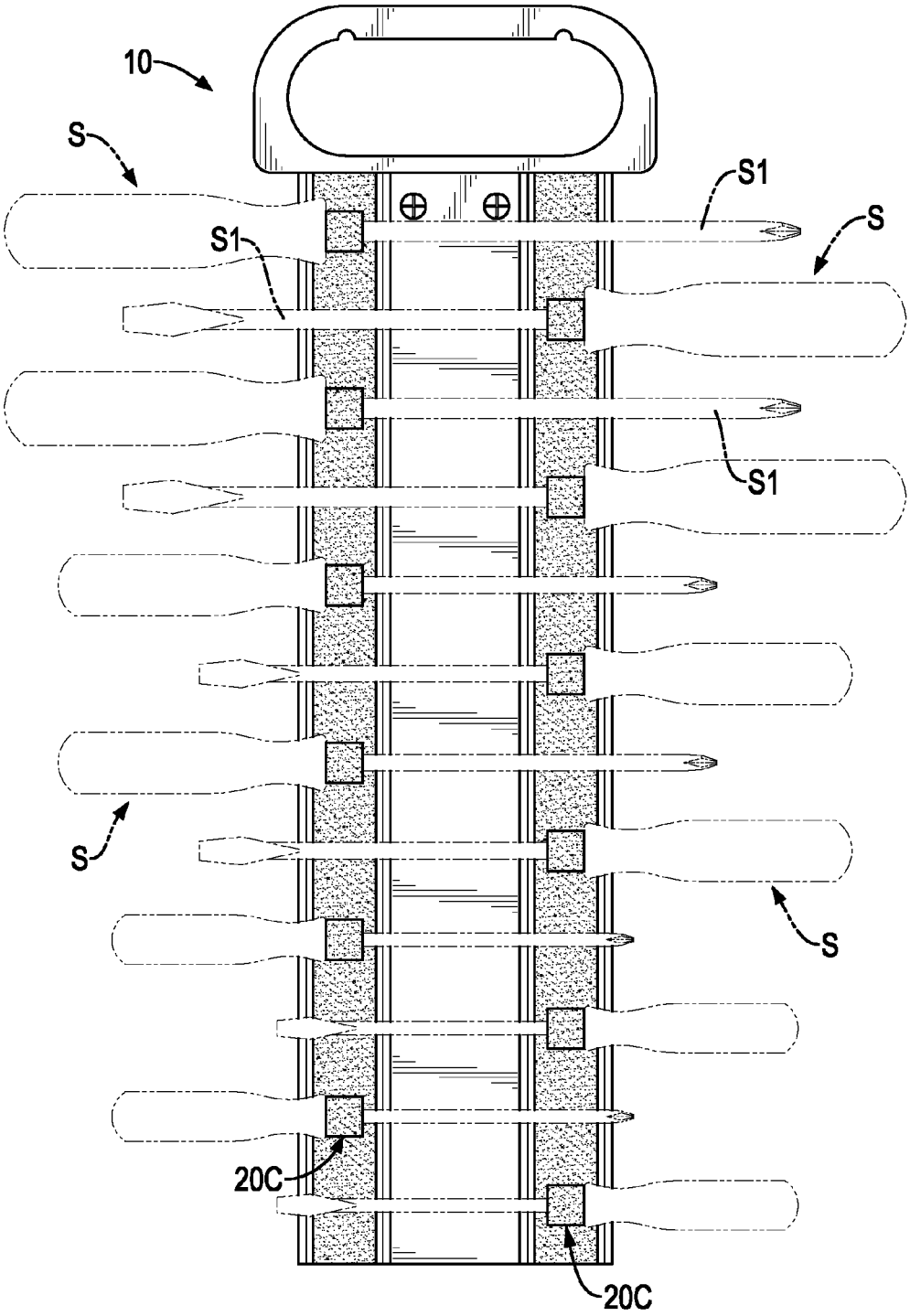
FIG. 14 is an operational front view of the screwdriver hanging assembly
Figure 15:
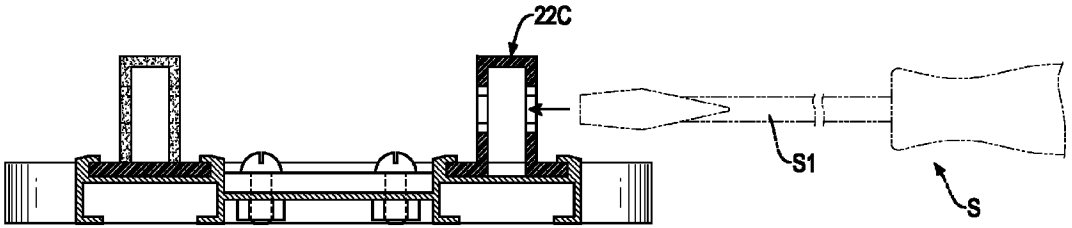
FIG. 15 is an operational cross sectional side view of the screwdriver hanging assembly in FIG. 11 showing a screwdriver being about to be mounted through the bracket.
Figure 16:
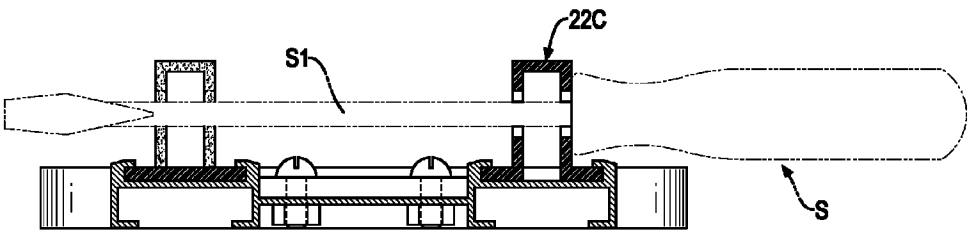
FIG. 16 is an operational cross sectional side view of the screwdriver hanging assembly in FIG. 15 showing a screwdriver held by the screwdriver hanging assembly.
Figure 17:
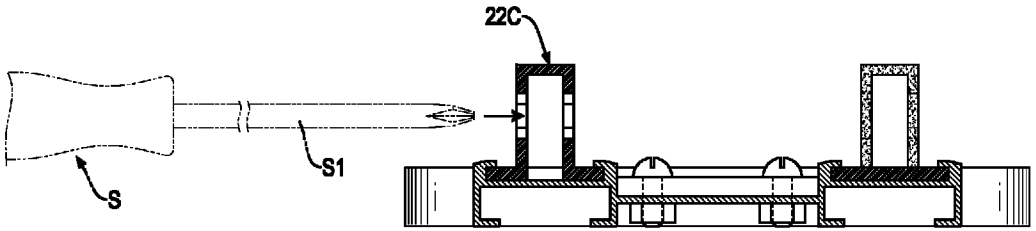
FIG. 17 is an operational cross sectional side view of the screwdriver hanging assembly in FIG. 11 showing a screwdriver being about to be mounted through the bracket.
Figure 18:
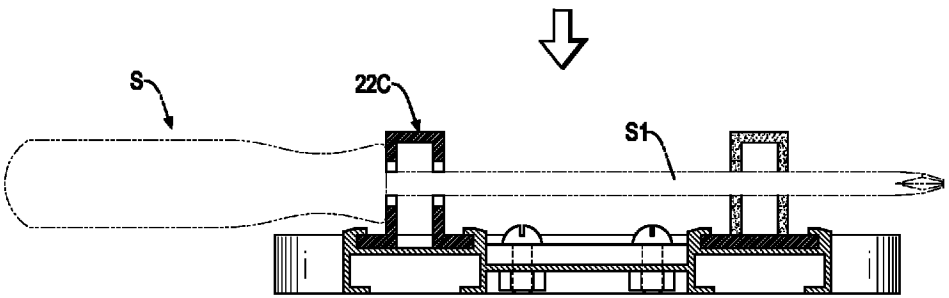
FIG. 18 is an operational cross sectional side view of the screwdriver hanging assembly in FIG. 15 showing a screwdriver held by the screwdriver hanging assembly.

With reference to FIG. 10, the brackets 22 of one of the connecting devices 20 respectively align the chunks 23 of the other of the connecting devices 20, so two handles of adjacent two of the screwdrivers S do not bump each other. Consequently, multiple screwdrivers S can be held by the screwdriver hanging assembly in accordance with the present invention.

With reference to FIGS. 11 to 14, a second embodiment of the screwdriver hanging assembly is substantially the same as the first embodiment except the following features.

The second embodiment of the screwdriver hanging assembly does not have the enlarged holes 221, the first shank holes 222, the second shank holes 223, the bracket openings 224 and the chunks 23. Each bracket 22C has a slot 226C and a through hole 227C. The slot 226C of each bracket 22C is elongated, is formed through the bracket 22C and has a central segment. The through hole 227C of each bracket 22C is formed through the bracket 22C at the central segment of the slot 226C, communicates with the slot 226C and has a round cross section.

Each connecting device 20C has multiple spaces 24C formed between the brackets 22C of the connecting device 20C at intervals, wherein the spaces 24C of the first connecting device respectively align with the brackets 22C of the second connecting device and the brackets 22C of the first connecting device respectively align with the spaces 24C of the second connecting device.

With reference to FIGS. 15 to 18, accordingly, a distal tip of a shank S1 of a screwdriver S is mounted through one of the slots 226C. The shank S1 is mounted through a corresponding one of the through holes 227C.

From the above description, it is noted that the present invention has the following advantages:

1. Quick Assembling:

Each connecting device 20 with the multiple brackets 22 can hold the multiple screwdrivers S. Because combining the connecting devices 20 having the multiple brackets 22 with the main frame 10 is easy, to assemble the connecting devices 20 with the main frame 10 is fast, reduces manufacturing cost and is convenient for holding multiple screwdrivers S.

2. Suitable Positioning Effect:

Because the shanks S1,S2 of different sizes can be put into the first shank holes 222 or the second shank holes 223, a suitable positioning effect is provided.

3. Easily Taking Out the Screwdrivers:

The position where the shank S1,S2 abuts the chunk 23 serves as a fulcrum to facilitate lifting and taking out the shank S1.

4. Enlarged Receiving Space:

The brackets 22 of one of the connecting devices 20 respectively align the chunks 23 of the other of the connecting devices 20, so two handles of adjacent two screwdrivers S do not touch each other. Consequently, more screwdrivers S can be held by the screwdriver hanging assembly than by the conventional hanger assembly.

What is claimed is:

1. A screwdriver hanging assembly comprising:

a main frame having;

a hanging hole formed through the main frame; and two elongated track grooves parallel to each other, each track groove having two elongated edges;

a bottom;

two elongated strips parallel to each other and respectively and integrally connected with the edges of the track groove; and a positioning hole formed through the bottom of the track groove; and two elongated connecting devices respectively connected with the track grooves and respectively defined as a first connecting device and a second connecting device, and each connecting device having a base plate securely mounted in a corresponding one of the track grooves and having a length the same as that of the corresponding track groove;

an abutted surface abutting the bottom of the corresponding track groove;

a connecting surface opposite to the abutted surface of the base plate and abutted by the two strips of the corresponding track groove; and a button mounted securely on and protruding from the abutted surface and mounted in and engaging the positioning hole of the corresponding track groove;

multiple brackets securely mounted on the connecting surface at intervals, and each bracket in sequence having an enlarged hole formed through the bracket and adjacent to the connecting surface;

a first shank hole formed through the bracket, communicating with the enlarged hole and having a diameter;

a second shank hole formed through the bracket, communicating with the first shank hole and having a diameter different from that of the first shank hole; and a bracket opening formed in an end surface of the bracket opposite to the corresponding connecting surface, formed through the bracket and communicating with the second shank hole, wherein the enlarged hole, the first shank hole, the second shank hole and the bracket opening of each bracket are arranged in a straight line; and multiple chunks securely mounted on the connecting surface of the connecting device at intervals and respectively between the brackets, wherein the chunks of the first connecting device respectively align with the brackets of the second connecting device and the brackets of the first connecting device respectively align with the chunks of the second connecting device.

2. The screwdriver hanging assembly as claimed in claim 1, wherein each bracket further has an extending hole formed through the bracket, located between and communicating with the first shank hole and the second shank hole and having a width shorter than the diameters of the first shank hole and the second shank hole.

3. The screwdriver hanging assembly as claimed in claim 2, wherein the diameter of each first shank hole is smaller than that of each second shank hole.

4. The screwdriver hanging assembly as claimed in claim 1, wherein the diameter of each first shank hole is smaller than that of each second shank hole.

5. A screwdriver hanging assembly comprising:

a main frame having;

a hanging hole formed through the main frame; and two elongated track grooves parallel to each other, each track groove having two elongated edges;

a bottom;

two elongated strips parallel to each other and respectively and integrally connected with the edges of the track groove; and a positioning hole formed through the bottom of the track groove; and two elongated connecting devices respectively connected with the track grooves and respectively defined as a first connecting device and a second connecting device, and each connecting device having a base plate securely mounted in a corresponding one of the track grooves and having a length the same as that of the corresponding track groove;

an abutted surface abutting the bottom of the corresponding track groove;

a connecting surface opposite to the abutted surface of the base plate and abutted by the two strips of the corresponding track groove; and a button mounted securely on and protruding from the abutted surface and mounted in and engaging the positioning hole of the corresponding track groove;

multiple brackets securely mounted on the connecting surface at intervals, and each bracket having an elongated slot formed through the bracket and having a central segment; and a through hole formed through the bracket at the central segment of the slot, communicating with the slot and having a round cross section; and multiple spaces formed between the bracket of the connecting device at intervals, wherein the spaces of the first connecting device respectively align with the brackets of the second connecting device and the brackets of the first connecting device respectively align with the spaces of the second connecting device.

* * * * *